US005896950A

United States Patent [19]

Koh

[11] Patent Number: 5,896,950

[45] Date of Patent: Apr. 27, 1999

[54] POSITION CONTROL METHOD FOR ELEVATOR

[75] Inventor: Eun Man Koh, Kyungsangnam-Do, Rep. of Korea

[73] Assignee: LG Industrial Systems Co., Ltd., Seoul, Rep. of Korea

[21] Appl. No.: 08/755,911

[22] Filed: Nov. 25, 1996

[30] Foreign Application Priority Data

Dec. 1, 1995 [KR] Rep. of Korea ..... 95-46029

[51] Int. Cl.[6] ..... B66B 1/28; B66B 1/34

[52] U.S. Cl. ..... 187/295; 187/394

[58] Field of Search ..... 137/393, 391, 137/293, 294, 290, 394

[56] References Cited

U.S. PATENT DOCUMENTS

| | | | |
|---|---|---|---|
| 4,470,482 | 9/1984 | Husson | 187/29 R |
| 4,494,628 | 1/1985 | Uherek et al. | 187/29 R |
| 4,501,344 | 2/1985 | Uherek et al. | 187/29 R |
| 4,658,935 | 4/1987 | Holland | 187/122 |
| 4,691,807 | 9/1987 | Iwata | 187/117 |
| 5,035,301 | 7/1991 | Skalski | 187/118 |
| 5,686,707 | 11/1997 | Iijima | 187/291 |

FOREIGN PATENT DOCUMENTS

| | | |
|---|---|---|
| 59-177275 | 10/1984 | Japan . |
| 6-80326 | 3/1994 | Japan . |

*Primary Examiner*—Robert E. Nappi
*Attorney, Agent, or Firm*—Oliff & Berridge, PLC

[57] ABSTRACT

An improved position control method for an elevator by which the system does not receive any overload even when the speed pattern of the cage is changed while the cage is operated in accordance with the position error occurred. The method includes the steps of a first step for computing a running distance to a service floor when a passenger registers a call, generating a speed pattern in accordance with the distance computed, and operating a cage in accordance with the speed pattern, a second step for re-computing the running distance of the cage based on a position difference error when the position difference error occurs during the operation of the cage, and a third step for re-computing the speed pattern in accordance with the running distance computed in the second step.

1 Claim, 7 Drawing Sheets

POSITION CONTROL METHOD FOR ELEVATOR

BACKGROUND OF THE INVENTION

1. Field of the Invention

The present invention relates to a position control method for an elevator, and in particular to a position control method for an elevator by which the cage of an elevator can arrive at a desired floor by computing a speed pattern of a cage before the elevator is operated and controlling the position of the cage which is operated in accordance with the computed speed pattern, and which is capable of judging the position of the cage based on the pulse from a position detector, and changing the speed pattern based on an error when the error occurs between the judged position of the cage and the position of the cage which was previously set, so that the cage is more accurately operated based on the changed speed pattern.

2. Description of the Conventional Art

FIG. 1 is a view illustrating the construction of a conventional elevator position control apparatus.

As shown therein, the conventional position control apparatus for an elevator includes a cage 2, a position detector 3 having a permanent magnet 31 and a reed switch 32 and disposed in an upper portion of the cage 2 for outputting a position detection signal in cooperation with a shield plate 4 disposed in a side wall of a cage moving path 1, a motor 9, an encoder 10 for outputting a pulse corresponding to the number of rotations of the motor 9, an operation controller 6 for judging the position of the cage 2 based on the position detection signal from the position detector 3 and the output signal from the encoder 10 when a floor call is requested from the cage 2 and for outputting a speed command signal v* so as to move the cage 2 to a service floor, a motor controller 7 for outputting a control signal cs for controlling the speed of the motor 9 in accordance with the speed command signal v* inputted thereto, and an inverter 8 for receiving the control signal cs and for outputting a phase voltage to the motor 9.

When the height of the bottom of the cage 2 is the same as the bottom of the floor 5, the position detector 3 disposed in the upper portion of the cage 2 is positioned at the center portion of the shield plate 4. Therefore, as the cage 2 is moved, when the position detector 3 passes through the shield plate 4, a magnetic force from the permanent magnet 31 is blocked by the shield plate 4, and then the reed switch 32 is turned off.

The position control process of the conventional position detection apparatus for an elevator will now be explained with reference to the accompanying drawings.

Before the elevator is normally operated, the operation controller 6 operates the cage 2 from the lowest floor to the highest floor so as to set a floor height value of each floor. Here, the lowest floor is assumed as a first floor.

When the cage 2 is operated from the first floor, the encoder 10 outputs a pulse corresponding to the number of rotations of the motor 9, and output pulse is inputted to the operation controller 6, and a direct current voltage Vdc is supplied to the operation controller 6 through the reed switch 32 of the position detector 3.

When the cage passes through the second floor, the magnetic force from the permanent magnet 31 is blocked by the shield plate 4, and then the reed switch 32 is turned off, whereby the supply of the direct current voltage Vdc to the operation controller 6 is stopped. The operation controller 6 accumulates the number of pulses from the encoder 10, and sums the number of pulses from the encoder 10, which number corresponds to a length of 125 mm which is half of the length of the shield plate 4, and summed value is stored as a floor height value corresponding to the height between the first floor and the second floor. The above-described processes are repeated during the operation of the cage 2 from the highest floor to the lowest floor, for thus storing the floor height value of each floor.

After the floor height value is stored, when a user (passenger) registers the service floor at the floor 1 or in the cage 2, the operation controller 6 computes the distance from the current floor to the service floor, namely, the distance "disti" within which the cage 2 is operated.

$$\text{dist}=Pd-Po \tag{1}$$

where Po denotes a floor height value of the current floor, and Pd denotes a floor height value of the service floor.

Next, the operation controller 6 determines the speed pattern from the distance "dist" within which the cage 2 is operated. The speed pattern will now be explained with reference to FIGS. 2 through 3D.

FIG. 2 is a graph of the acceleration based on a running time of an elevator in the conventional art. As shown therein, there are seven intervals PS1 through PS7 in accordance with the pattern of the acceleration. Here, PS1 and PS5 are referred to intervals within which the acceleration is increased. PS2 and PS6 are referred to intervals within which the acceleration is constant. PS3 and PS7 are referred to intervals within which the acceleration is reduced. PS4 is referred to an interval within which the acceleration is zero. In addition, J1, J2, J3, and J4 are referred as a jerk (the rate of change of acceleration).

The speed of each interval is as follows:

$$V_1(kT)=\tfrac{1}{2}(kT)^2$$

$$V_2(kT)=J(k_1T)(kT)+V_1(k_1T)$$

$$V_3(kT)=-\tfrac{1}{2}(kT)^2+J(k_1T)(kT)+V_2(k_2T)$$

$$V_4(kT)=V_3(k_1T)$$

$$V_5(kT)=-\tfrac{1}{2}(kT)^2+V_4(k_4T)$$

$$V_6(kT)=-J(k_1T)(kT)+V_5(k_1T)$$

$$V_7(kT)=\tfrac{1}{2}(kT)^2-J(k_1T)(kT)+V_6(k_2T)$$

The distance $P_i(kT)$ of each interval can be obtained by integrating the speed of each interval with respect to time as follows:

$$P_i(kT)=V_i dt,\ i=1, 2, \ldots, 7 \tag{3}$$

$$P_7(T_1)dist+Po$$

Therefore, the total distance "dist" within which the cage 2 is operated is obtained as follows from the distance $P_i(kT)$.

$$\text{dist}=2J(k_1T)^3+3J(k_1T)^2(k_2T)+J(k_1T)^2(k_4T)+J(k_1T)(k_2T)^2+J(k_1T)(k_2T)(k_4T) \tag{4}$$

The speed pattern of each interval is determined based on Equation (4). In addition, since the acceleration "J" and the intervals (SP1, SP3, SP5, and SP7) within which the acceleration is varied are previously set, the unknown values are $k_2T$ and $k_4T$.

Therefore, so as to solve the unknown values, four different acceleration patterns are used as shown in FIG. 3.

FIG. 3*a* illustrates the acceleration pattern when the distance of the intervals SP2, SP4, and SP6 are zero (0), respectively, and Dref1 denotes the minimum distance within which the cage can be operated. FIG. 3B illustrates the acceleration pattern when the distance of the interval SP4 is zero (0), and FIG. 3C illustrates the acceleration pattern when the distance of the interval SP4 is zero (0), and when the cage 2 reaches the rated speed, and FIG. 3D illustrates the acceleration pattern when the cage 2 is operated at the rated speed, and when the interval SP4 is variable. In addition, as shown in FIGS. 3C and 3D, the area "b" is as the rated speed, and "a" denotes the distance when the cage reaches at the rated speed.

Here, since the intervals SP2, SP4, and SP6 are zero (0), the distance $Dref_1$ is as follows.

$$D_{ref1}=2J(k_1T)^3 \tag{5}$$

Since the area "b" is the rated speed, and the interval SP4 is zero (0), the distance Dref2 can be obtained by the following equation. Here, $A_{MAX}$ denotes the maximum value of the acceleration.

$$V_{REF}=(k_1T+k_2T)A_{MAX}$$

$$k_2T=V_{REF}/A_{MAX}-k_1T$$

$$A_{MAX}=J(k_1T)$$

$$D_{ref2}=J(k_1T)[2(k_1T)^2+3(k_1T)(k_2T)+(k_2T)^2] \tag{6}$$

The operation controller 6 judges the appropriate acceleration pattern at which the cage 2 is being operated from the four acceleration patterns. This process will now be explained with reference on FIG. 4.

If the distance "dist" within which the cage 2 is operated is shorter than the minimum distance Dref1 in step S41, it is judged that the system has a predetermined error.

In addition, if the distance "dist" within which the cage 2 is operated is longer than the distance Dref1, and shorter than the distance Dref2 in step S42, the pattern with which the cage 2 is operated is shown in FIG. 3B. In this case, since $k_4T$ is zero (0) in accordance with Equation 4, the value of $k_2T$ is computed in step S43.

In addition, if the distance "dist" within which the cage 2 is operated is longer than the distance Dref2, and when the speed of the cage 2 reaches the rated speed of $V_{REF}$, the value of $k_2T$ is the same as the value computed based on Equation (6) in step S44, and the value of $k_4T$ is computed by substituting the computed value $k_2T$ into Equation 4 in step S45.

When the speed pattern with which the cage 2 is operated is determined, the position $P_i(kT)$ of the cage 2 within each interval PSi is computed based on Equation 4 in step S46.

The position $P_i(kT)$ of the cage 2 is stored as a reference position Pr, and then the cage 2 is in a ready mode for operation.

The operation controller 6 outputs a speed command signal v* in accordance with the determined speed pattern, and then the motor 9 is driven so as to drive the cage 2. The pulse from the encoder 10 which pulse corresponds to the number of the rotation of the motor 9 is inputted to the operation controller 6.

The operation controller 6 detects the current position of the cage 2, namely, a synchronous position Pc, in accordance with the pulse inputted thereto, compares the synchronous position Pc with the reference position Pr, computes a position difference OFFSET, and outputs the value obtained by multiplying the position difference OFFSET by a predetermined gain GAIN as a new speed command signal v*.

$$v^*=GAIN*OFFSET \tag{7}$$

As described above, during the operation of the cage 2, the number of pulses from the encoder 10 may be different from the number of pulses counted by the operation controller 6 due to an unknown cause occurred in the system. In addition, when a rope connecting the cage 2 and a counterweight 11 may be elongated, for thus causing a slippage between a sheave and the rope, there may be an error between the position of the cage 2 which is judged based on the output pulse from the encoder 10 and the actual position of the cage 2. In this case, the cage can not accurately arrive at the service floor.

Therefore, so as to overcome the above-described problems, the synchronous position is corrected by using a device such as a position detector.

However, in the conventional position control method of outputting the position error corrected the synchronous position, when the position difference OFFSET is large, since the speed command signal may be significantly change, the motor which is driven in accordance with the speed command signal may be overloaded, thus causing a malfunction of the system.

Namely, as shown in FIGS. 3C and 3D, the maximum value of the rated speed is set as "a". However, when the speed is increased within the intervals SP1, SP2, and SP3 as shown in FIGS. 3C and 3D, the cage 2 is operated at over rated speed "a", and thus causing the malfunction of the motor.

In addition, when the speed command signal is changed within the intervals SP1, SP2, SP5, and SP7 within which the acceleration is changed, the speed pattern becomes discontinuous, and thus causing the system to be unstable, and the ride of the cage 2 is bad.

Moreover, the cage may not accurately arrive at the service floor due to overloading of the system.

SUMMARY OF THE INVENTION

Accordingly, it is an object of the present invention to provide a position control method for an elevator which overcomes the problems encountered in the conventional art.

It is another object of the present invention to provide an improved position control method for an elevator which is capable of resetting the position of a service floor in accordance with the occurred position error and operating the cage based on the reset service floor.

It is still another object of the present invention to provide an improved position control method for an elevator by which the system does not receive any overload even when the speed pattern of the cage is changed while the cage is operated in accordance with the occurred position error.

To achieve the above objects, there is provided a position control method for an elevator which includes the steps of a first step for computing a running distance to a service floor when a passenger registers a call, generating a speed pattern in accordance with the computed distance, and operating a cage in accordance with the speed pattern, a second step for re-computing the running distance of the cage based on a position error when the position error occurs during the operation of the cage, and a third step for re-computing the speed pattern in accordance with the running distance computed in the second step.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
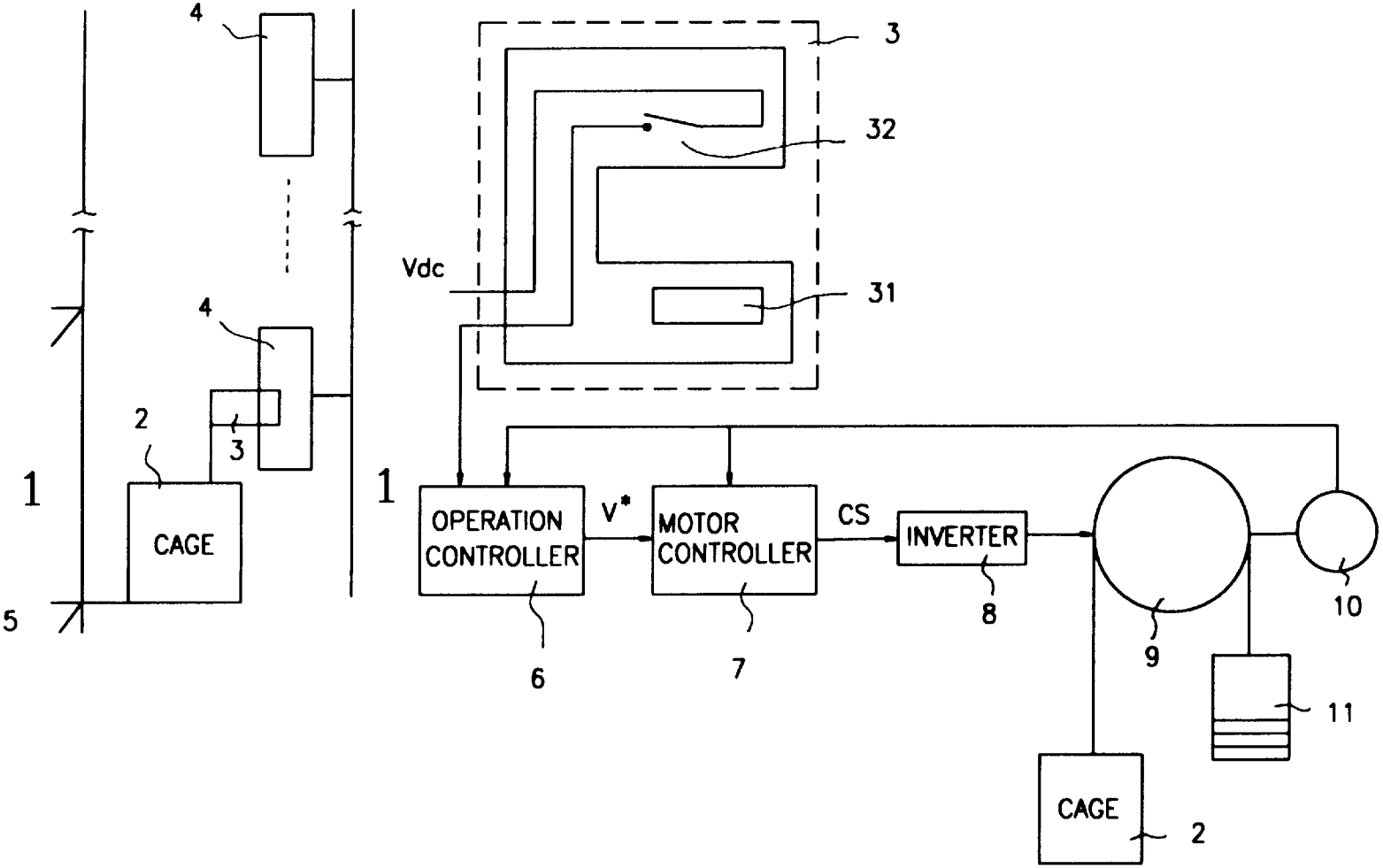
FIG. 1 CONVENTIONAL ART
FIG. 1 is a view illustrating the construction of a conventional elevator position control apparatus.
Figure 2:
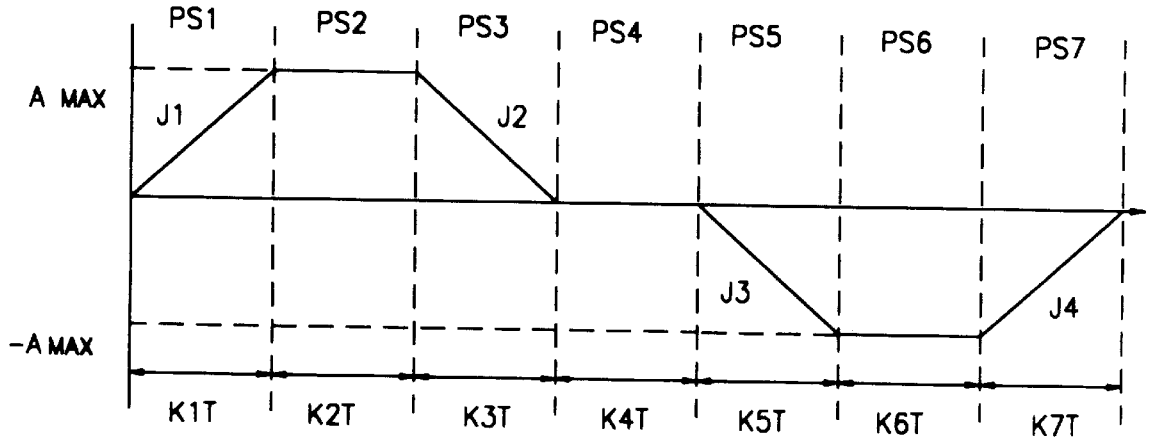
FIG. 2 CONVENTIONAL ART
FIG. 2 is a graph of the acceleration of the cage according to the conventional art.
Figure 3A:
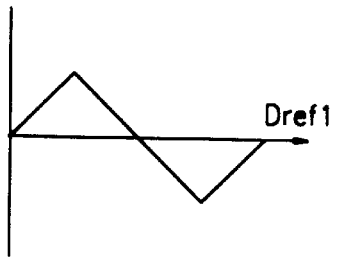
FIG. 3A CONVENTIONAL ART
FIGS. 3A through 3D are views illustrating four acceleration patterns of a cage in the conventional art.
Figure 3B:
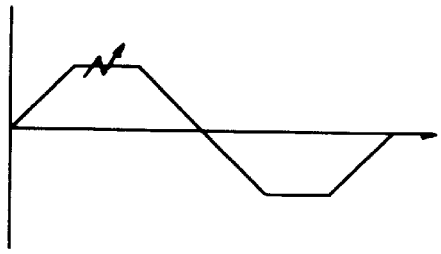
FIG. 3B CONVENTIONAL ART
Figure 3C:
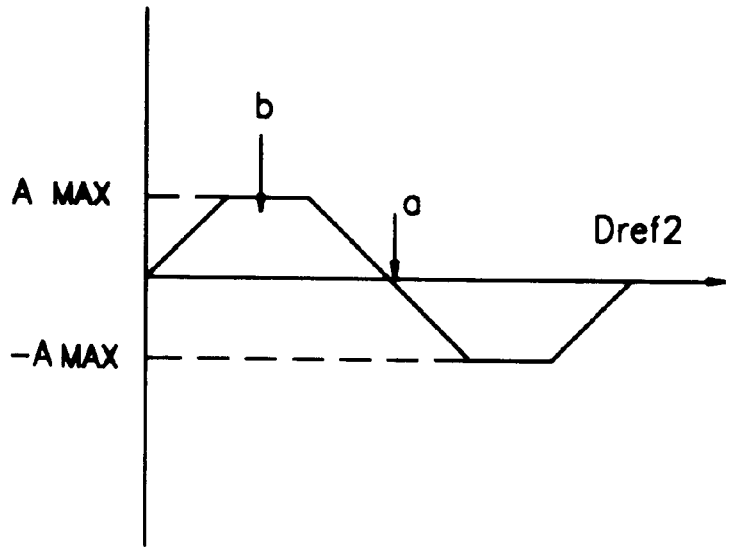
FIG. 3C CONVENTIONAL ART
Figure 3D:
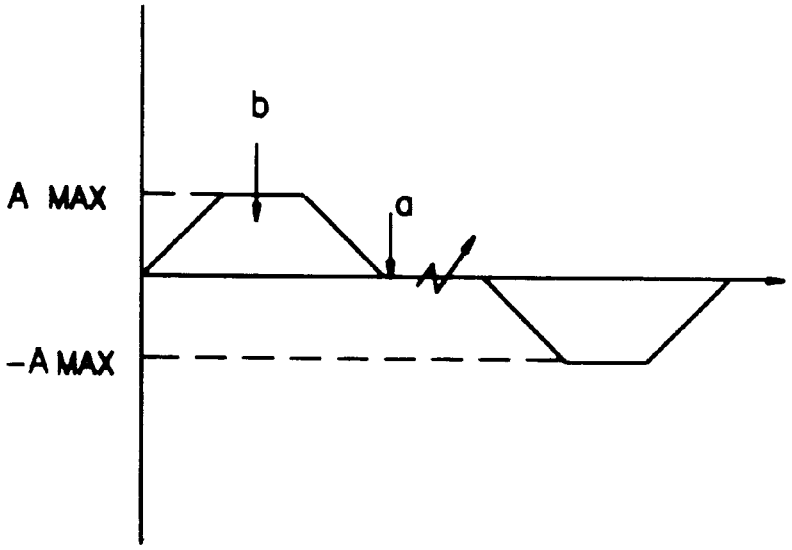
FIG. 3D CONVENTIONAL ART
Figure 4:
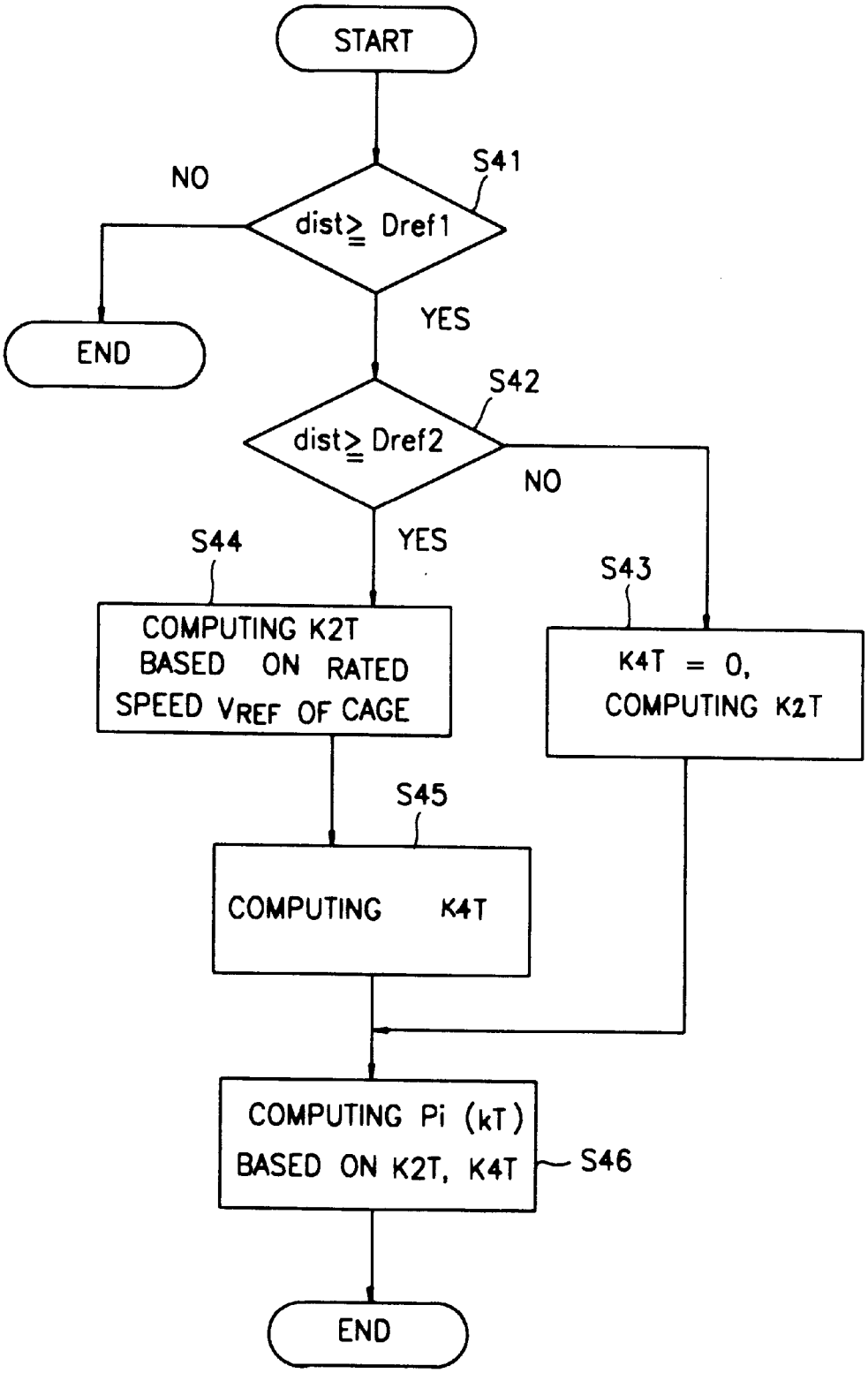
FIG. 4 CONVENTIONAL ART
FIG. 4 is a flow chart of a computation process of a speed pattern of a cage by using an operation controller based on a conventional elevator position control method.

Identically with the conventional position control method for an elevator, as shown in FIG. 1, the operation controller 6 computes and stores the floor height value of each floor. In addition, the distance between the current floor and the service floor, namely, the distance "dist" within which the cage is operated, is computed based on Equation 1. Moreover, the speed pattern is computed from the distance "dist", and the cage is operated in accordance with the computed speed pattern, and the current position, namely, the synchronous position Pc, is detected based on the operation of the position detector. Namely, the above-described processes are the same as the conventional art.

Figure 5A:
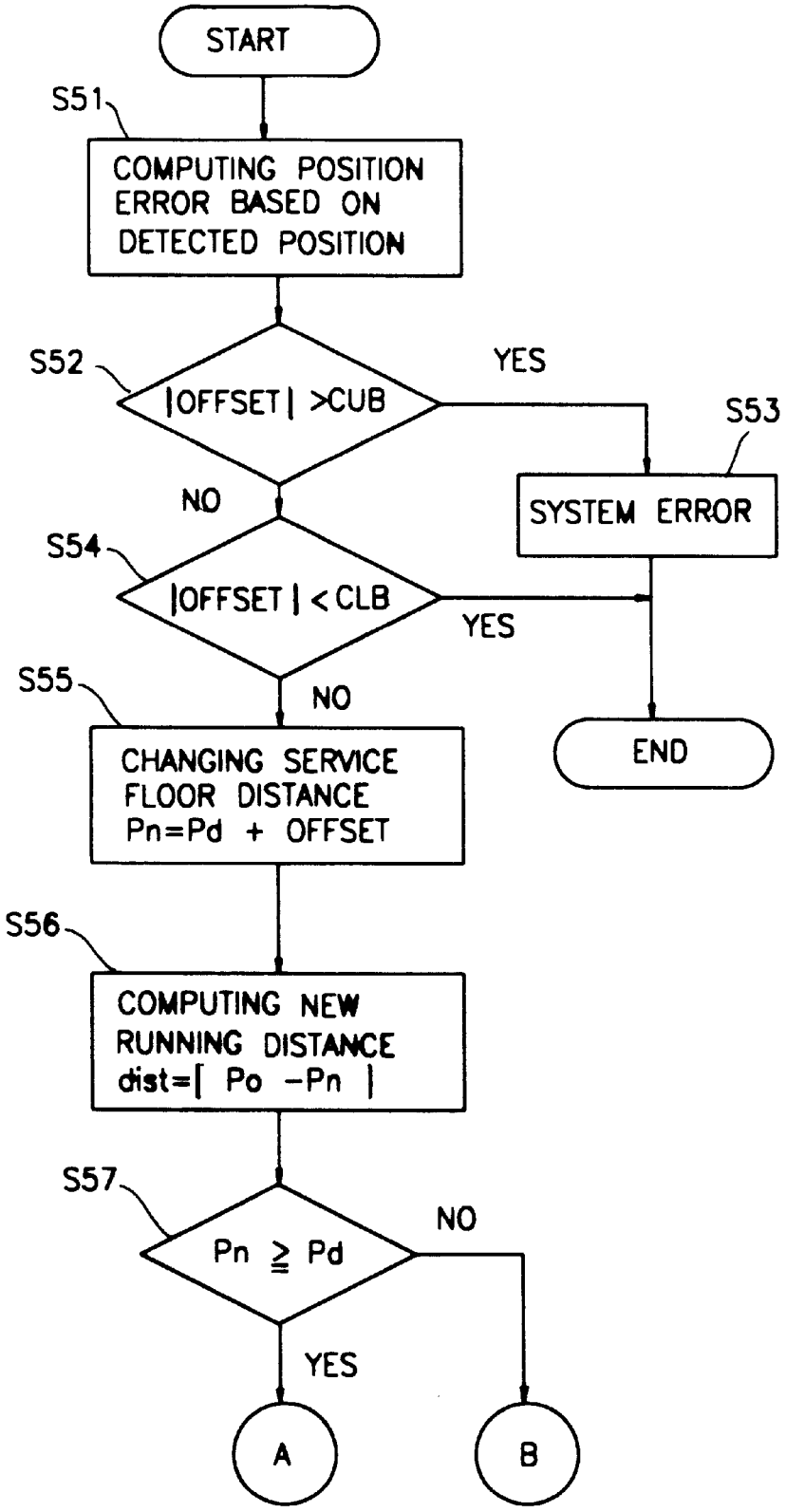
FIGS. 5A and 5B are a flow chart of an elevator position control process according to the present invention.
Figure 5B:
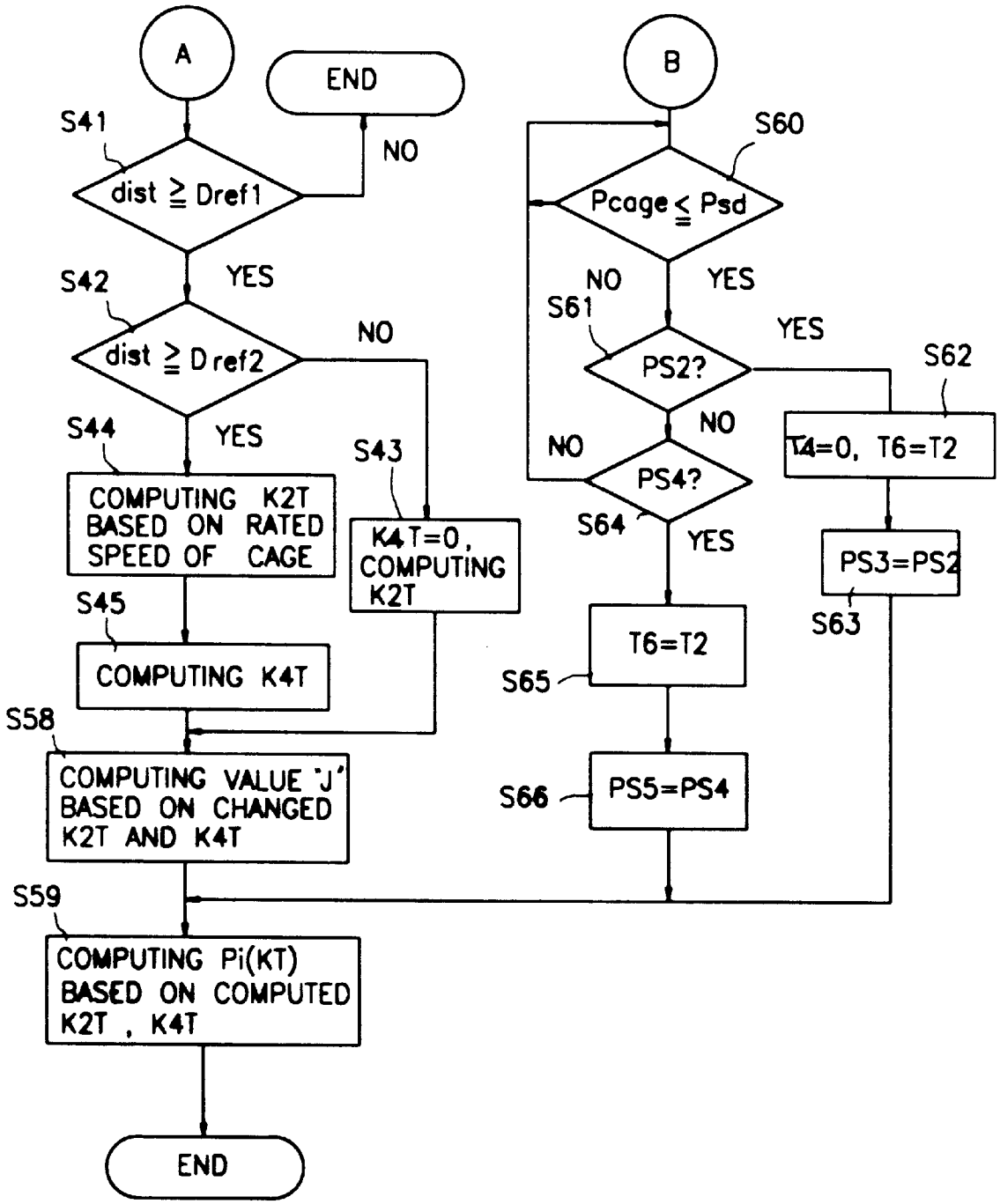
Figure 6:
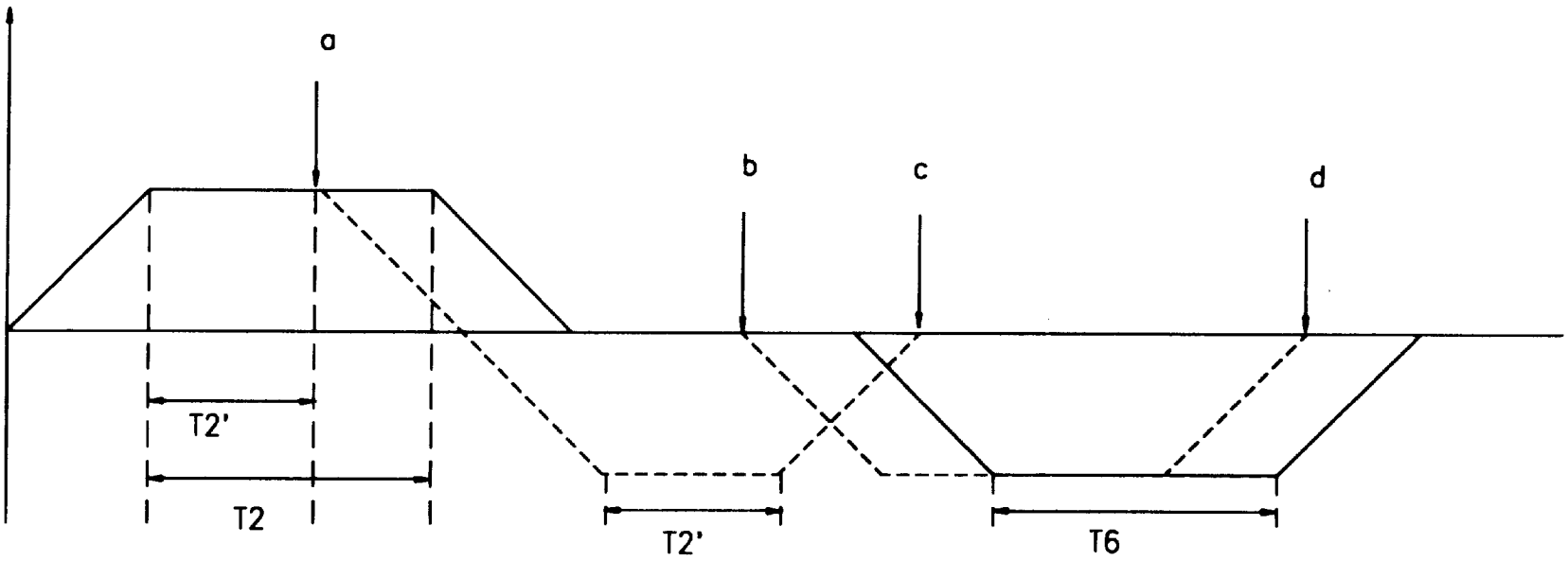
FIG. 6 is a view illustrating an acceleration pattern of a cage, in the case that a distance Pn of a changed service floor is shorter than a distance Pd of an original service floor according to the present invention.

FIG. 5 is a flow chart of an elevator position control process according to the present invention, and FIG. 6 is a view illustrating an acceleration pattern of a cage, in the case that a changed distance Pn of a service floor is shorter than a distance Pd of an original service floor according to the present invention.

As shown therein, the operation controller 6 compares the current position of the cage 2, namely, the synchronous position Pc with the reference position Pr, and computes the position error OFFSET in step S51. If the position error OFFSET is greater than a critical upper bound value (CUB) in step S52, it is judged that the system has a problem in step S53, and then the routine is stopped. Here, the critical upper bound value CUE is the maximum value which may cause a position error on the assumption that the system is normally operated. In addition, if the position error OFFSET exceeds the critical upper bound (CUB), it means that there is a predetermined error in the position control apparatus.

In addition, if the absolute value of the position error OFFSET is less than a critical lower bound value (CLB) in step S54, the cage is judged to be operating normally and the routine is stopped. Here, the critical lower bound value (CLB) is a predetermined value which is obtained during the computation.

Therefore, if the position error OFFSET is less than the CUB, and is greater than the CLB, the position error OFFSET is added to the distance Pd of the initial service floor, for thus computing the distance Pn of the new service floor in step S55, and the operation distance "dist" is re-computed as follows in step S56.

$$\text{dist}=|Po-Pn| \quad (7)$$

Next, the speed pattern is computed. Here, both the cases that the distance Pn of the changed service floor is longer, and the distance Pn of the changed service floor is shorter than the distance Pd of the original service floor are considered, respectively.

First, if the distance Pn of the changed service floor is longer than the distance Pd of the original service floor, the intervals $k_2T$ and $k_4T$ are computed identically as in the conventional art in steps S41 through S45, and the jerk J is computed based on the changed intervals $k_2T$ and $k_4T$ in step S58. Here, in the conventional art, the jerk J was the fixed value within the entire interval within which the cage is operated; however, in the present invention, the jerk J3 and J4 within the intervals SP3 and SP4 are substituted with a new jerk J, for thus preventing the rated speed $V_{REF}$ from being changed within the previous interval.

For example, when the jerk J is newly obtained within the interval SP2, the jerk J is not substituted with the jerk J2 but substituted with jerk J3 and J4 within the interval SP5.

On the contrary, if the distance Pn of the changed service floor is shorter than the distance Pd of the original service floor, the cage must be decelerated within the intervals PS2 and PS4 whereby the accelaration is constant.

Namely, it is judged that the current position Pcage of the cage is at the position Psd, whereby position Psd means the position of the cage at which deceleration must be begun in order for the cage to accurately arrive at the changed service floor. Therefore, if the current position Pcage of the cage is the position Psd, it is judged that the current position Pcage is referred to which interval in steps S61 and S64.

As shown in FIG. 6, if the position of the changed service floor is a position "c", as indicated by a dotted line, the pattern of the cage is changed to the deceleration pattern, and then the position at which the cage can accurately arrive is a position "a". Namely, the pattern of the cage must be changed to the deceleration pattern so that the cage can arrive at the position "c" of the changed service floor, and the distance of the interval PS5 must be set to a new distance of T2' of the interval PS2.

Therefore, if the current position Pcage of the cage is within the interval PS2 in step S61, the current interval is changed to the interval PS3, and the distance T6 of the interval PS6 is set as the distance T2' of the interval PS2 as shown in FIG. 6 in steps S62 and S63.

In addition, if the current position is within the interval PS4 in step S64, the distance T6 of the interval PS6 is set to have the same distance as the distance T2 of the interval PS2, and the current interval is changed to the interval PS5 in steps S65 and S66. Namely, if the position of the service floor change is "d", the position Psd becomes the position "b".

As described above, when the position error occurs, the cage is stopped at the time of the occurrence of the position error, and it is judged whether the cage can be operated by changing the speed of the cage, and then the cage is operated.

Therefore, in the position control method for an elevator according to the present invention, the speed command signal is not abruptly changed, for thus obtaining a safe operation of the system, whereby the system does not receive an overload, and the cage can accurately arrive at the service floor.

In addition, the ride of the cage can be improved without abruptly changing the speed of the cage.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A position control method for an elevator wherein a value of a position error is determined based on value of an operation position obtained by pulse-counting a number of motor rotations and a value of the current position of a car which is detected by a plurality of position detectors provided at predetermined positions along an elevator shaft in which the elevator travels, comprising the steps of:

a first step for determining a running distance to an original service position when a passenger registers a call, generating a speed pattern in accordance with the computed distance, and operating a cage in accordance with the speed pattern;

a second step for re-determining the running distance of the cage based on the position error when the position error occurs during the operation of the cage;

a third step for comparing the current position of the cage with a reference position, and determining the position error;

a fourth step for determining a distance of a changed service floor by adding/subtracting the position error to/from the distance of said original service floor; and a fifth step for re-determining said speed pattern in accordance with the running distance determined in the second step.

* * * * *